United States Patent [19]

Wilkinson

[11] Patent Number: 4,573,301

[45] Date of Patent: Mar. 4, 1986

[54] INTERLOCKING BUILDING BLOCKS

[76] Inventor: Rudolph P. Wilkinson, P.O. Box 1202, Ardmore, Okla. 73401

[21] Appl. No.: 467,709

[22] Filed: Feb. 18, 1983

[51] Int. Cl.[4] ..... E04B 5/04

[52] U.S. Cl. ..... 52/607; 52/221; 52/368; 52/375; 52/593

[58] Field of Search ..... 52/593, 607, 596, 606, 52/371, 364, 221, 585, 367, 368, 375, 376; 46/25

[56] References Cited

U.S. PATENT DOCUMENTS

| | | | |
|---|---|---|---|
| 699,537 | 5/1902 | Lahmann | 52/286 |
| 979,913 | 12/1910 | Ault | 52/607 |
| 1,255,761 | 2/1918 | Lenkerd | 52/314 |
| 1,477,867 | 12/1923 | Dodson | 52/593 X |
| 1,503,931 | 8/1924 | Wightman | 52/286 |
| 1,524,146 | 1/1925 | Murray | 52/607 X |
| 1,539,611 | 5/1925 | Trowbridge | 52/607 X |
| 1,552,077 | 9/1925 | Palanti | 52/286 |
| 1,980,982 | 11/1934 | Crawford | 52/367 X |
| 2,474,654 | 6/1949 | Carlson | 264/226 |
| 3,076,293 | 2/1963 | Baudoux | 52/286 |
| 3,137,967 | 6/1964 | Flieth | 52/93 |
| 3,391,507 | 7/1968 | Downing | 52/314 |
| 3,410,044 | 11/1968 | Moog | 52/286 |
| 3,628,232 | 12/1971 | Brewer | 29/407 |
| 3,888,060 | 6/1975 | Haener | 52/286 |
| 3,962,842 | 6/1976 | Wilhelm | 52/436 |
| 4,031,678 | 6/1977 | Schuring | 52/285 |
| 4,110,053 | 8/1978 | Buchholz | 403/361 |

FOREIGN PATENT DOCUMENTS

| | | | |
|---|---|---|---|
| 78840 | 1/1949 | Czechoslovakia | 52/376 |
| 584597 | 2/1977 | Switzerland | 52/606 |
| 2016058 | 9/1979 | United Kingdom | 52/606 |

*Primary Examiner*—Carl D. Friedman
*Assistant Examiner*—Naoko N. Slack
*Attorney, Agent, or Firm*—E. Harrison Gilbert, III

[57] ABSTRACT

Interlocking blocks for erecting a wall assembly formed by building blocks laid up in end to end abutting relation by multiple staggered block courses. The blocks of the wall assembly are characterized by at least one opening extending between its top and bottom surfaces with an upstanding endless tongue on its top surface surrounding the opening and nested by a rabbeted recess around the opening in the bottom surface nesting the endless tongue when one block is superposed on another. Coextensive grooves, formed in block side walls, receive furring strips. Nailable material blocks selectively secured to end surfaces of the blocks define wall openings.

6 Claims, 16 Drawing Figures

INTERLOCKING BUILDING BLOCKS

BACKGROUND OF THE INVENTION

1. Field of the Invention

The present invention relates to interlocking building blocks for constructing a building or wall.

It is common practice to erect walls using concrete blocks of rectangular configuration with each block having a plurality of cavities and planar on all six sides. The blocks are laid up in courses by placing mortar, by a trowel on the top of the blocks and then positioning the blocks of the next course in the mortar. Forming walls in this manner requires skilled craftsmen trained in the technique of laying concrete blocks to form a wall of predetermined height which is horizontally and vertically true and with the required strength to support an additional floor, roof, or the like.

This invention provides a wall forming series of building blocks which may be laid up by relatively unskilled workmen thus reducing the cost of building erection.

2. Description of the Prior Art

Prior patents generally disclose longitudinally or transversely extending webs usually formed on the upper surface of the building blocks which are nested by cooperating recesses or grooves formed in the depending surface of an overlying block.

The most pertinent prior patent is believed to be U.S. Pat. No. 979,913 which discloses a generally rectangular building block having vertical openings therethrough with each opening surrounded by an upstanding ledge nested by a recess formed in the depending surface of the next overlying block. The blocks of this patent are further provided on a side or end edge thereof with a mortise and tenon for interlocking abutting wall surfaces of the blocks against lateral movement.

This invention similarly uses a tongue and groove arrangement for interlocking the over and underlying blocks but is distinctive over the above named patent by providing a complete line of blocks forming a building structure including blocks having nailable end members for framing a wall opening, longitudinal lateral grooves in the block sides for receiving furring strips, supporting electrical outlet boxes, connecting plumbing fittings thereto and increasing the rigidity of the wall by vertical columns of concrete.

SUMMARY OF THE INVENTION

The building blocks of this invention comprise a series of blocks which may be formed from units of equal width and height with the length being a multiple of its width. One of the blocks, herein referred to as a standard size block, is dimensioned substantially identical with conventional building blocks known as concrete blocks having an equal width and height and a length twice its width. In addition to the standard size block, the series of blocks include a half block, a wall top block, a header block for overlying wall openings and lateral and end mortised blocks for supporting furring strips, baseboards and electrical outlet boxes. The standard size block is characterized by a pair of parallel vertical cavities or openings extending between its bottom and top surfaces with the upper surface of the block characterized by an endless upstanding tongue surrounding the respective opening which are cooperatively received by a cooperating rabbeted edge formed in the depending surface of each block so that an overlying block is held in vertical alignment and against horizontal movement with respect to the underlying block when placed thereon. The interlocking feature of the blocks permit a wall to be formed without the use of mortar, however, a wall formed by the blocks may be reinforced by pouring grout or cement into aligned vertical openings formed by the several blocks. In addition, a series of cooperatively dimensioned blocks, formed with a nailable material attached thereto, are provided for framing a rough wall opening.

The principal objects of this invention are to provide a series of building blocks capable of being erected in interlocking relation without the use of skilled workmen which are self aligning vertically and and horizontally and provide a nailable surface defining a roughed in building opening and which provides for the placement of furring strips and electrical outlet and plumbing fixtures.

DESCRIPTION OF THE PREFERRED EMBODIMENT

Figures 1, 2, 3, 4:
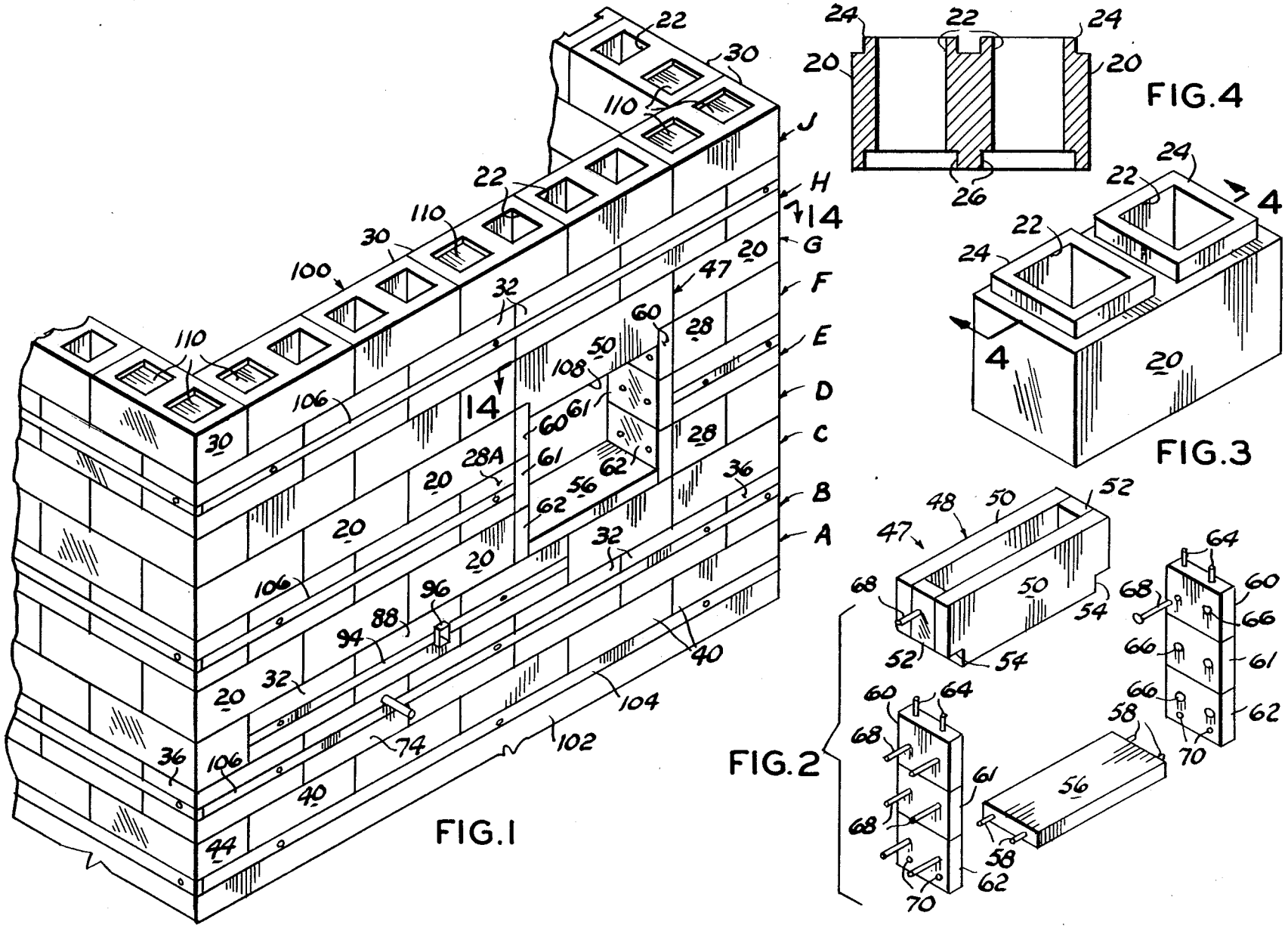
FIG. 1 is a fragmentary isometric view of walls formed by a plurality of the several building blocks.
FIG. 2 is an exploded isometric view of a wall opening framing components.
FIG. 3 is an isometric view of a standard size building block.
FIG. 4 is a vertical cross sectional view taken substantially along the line 4—4 of FIG. 3.

Like characters of reference designate like parts in those figures of the drawings in which they occur.

In the drawings:

Referring to FIGS. 3 through 6, the numeral 20 indicates a building block herein referred to as a standard size block in which its wall forming width and height are of equal dimensions with its length being twice its width. The block 20 is characterized by a pair of vertical rectangular openings or cavities 22 with the spacing between the openings and sides and ends of the block being equal and twice this dimension between the two openings centrally of the block. The block 20 is further characterized by an endless upstanding lip or tongue 24 projecting a distance at least equal to its thickness above the upper limit of the block, as viewed in FIGS. 3 and 4, with the transverse thickness of the tongue being substantially one-half the side and end wall thickness of the block. The depending surface of the block 20 is provided with a recess forming a rabbeted edge 26 which cooperatively nests the tongue 24 when a second standard size block 20 is superposed on a lower block.

The reference numeral 28 indicates a half size block defined as a block of equal height and width with respect to the standard size block but having a length one-half the standard size block. The half block 28 is similarly provided with the cavity 22, upstanding tongue 24 and depending rabbeted edge 26.

Figure 7:
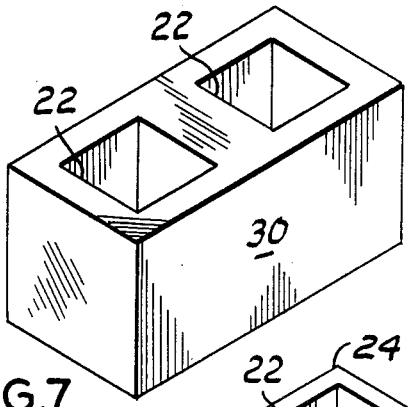
FIG. 7 is an isometric view of a standard size wall top course block.
Figure 6:
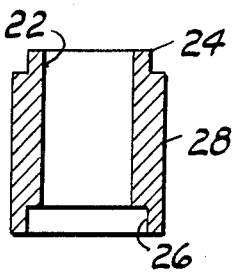
FIG. 6 is a vertical cross sectional view taken substantially along the line 6—6 of FIG. 5.
Figure 5:
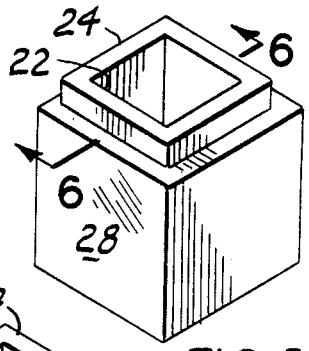
FIG. 5 is an isometric view of a half size block.

FIG. 7 illustrates a wall top course block 30, dimensioned substantially equal with respect to the standard size block 20, having identical size cavities 22 therethrough similarly having the depending rabbeted edge, not shown, and characterized by a planar upper surface surrounding the cavities 22 formed by omitting the upstanding tongue 24.

Figure 8:
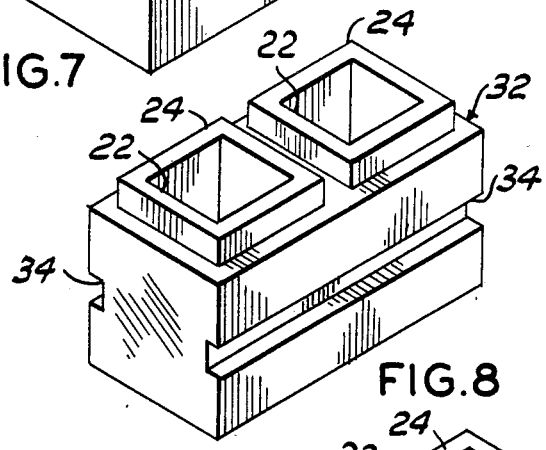
FIG. 8 is an isometric view of a standard size block having opposing lateral longitudinal recesses for receiving furring strips.

FIG. 8 illustrates a furring strip block 32 of substantially equal overall dimensions with respect to the standard size block 20 including the cavities 22, upstanding tongue 24 and rabbeted depending edge 26, not shown. The furring strip block is characterized by a longitudinally extending rectangular groove 34 in its opposing side walls intermediate the height of the block for receiving furring strips, as presently explained. A number of half size blocks, indicated at 28A (FIG. 1), are also provided with furring strip grooves in opposing side walls for the purpose believed apparent.

Figure 9:
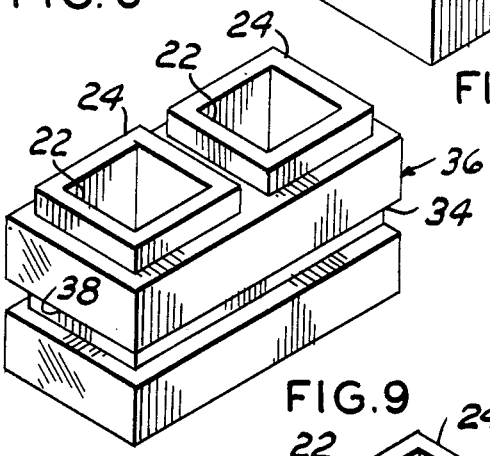
FIG. 9 is a view similar to FIG. 8 illustrating a wall corner standard size furring strip block.

As illustrated by FIG. 9, a wall end or corner furring strip block 36, substantially identical with the furring strip block 32, is further provided with an end wall furring strip groove 38 in alignment with the groove 34, for the purposes presently explained.

Figure 10:
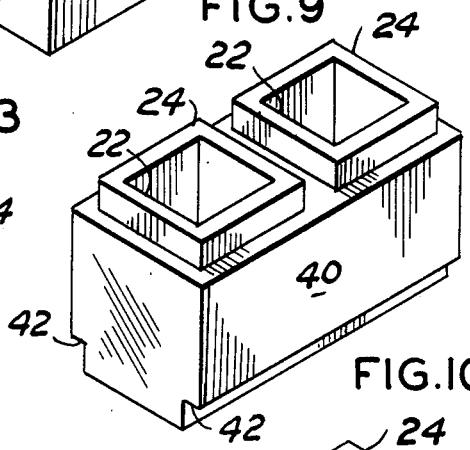
FIGS. 10 and 11 are views similar to FIGS. 8 and 9, respectively, illustrating standard size base course blocks.

FIG. 10 illustrates a similar base course standard size block 40 having opposing depending rabbeted side edges 42 for receiving a baseboard, as presently explained.

Figure 11:
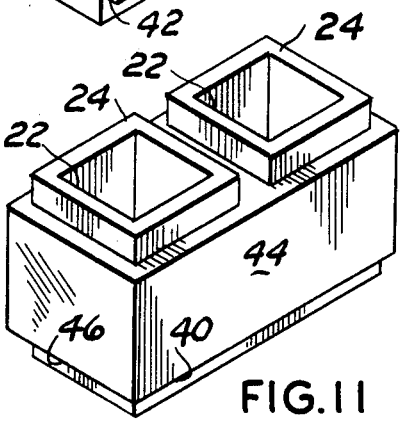

In FIG. 11, the numeral 44 illustrates a similar base course standard size block having a cooperating end wall baseboard receiving rabbeted edge 46 for the purposes presently explained.

Referring to FIG. 2, the numeral 47 indicates a window or door opening rough framing assembly including a wall opening spanning or header block formed from nailable material, indicated by the numeral 48, having a selected length, for example, equal to the combined length of a standard size block 20 and a half size block 28 defined by opposing spaced-apart side panels 50 of slightly greater dimension than the height of the standard block. The panels 50 are joined at their respective ends by end walls 52 and provided with a transverse rabbeted edge 54 underlying the respective end wall 52. A wall opening sill 56, preferably formed from suitable thickness nailable material, transversely equal to the width of the wall opening spanning block 48 and having a length equal to the spacing between the rabbeted edges 54, is provided at its respective ends with longitudinally extending dowel pins 58. A plurality of rectangular nailable material window or door opening jamb blocks 60, 61 and 62, each having a width and height equal to the end surface dimension of a standard size block and a thickness equal to the header block rabbeted edge 54, form the roughed in side jambs of a window opening, or the like. The top block 60 is characterized by a pair of upstanding dowel pins 64 for entering the spanning block end wall 52 and transversely spaced-apart openings 66 for receiving bolts or screws 68. The intermediate block 61 and lower block 62 are also provided with the pairs of openings 66 and similarly include the upstanding dowel pins 64 mateably received by holes 67 (FIG. 13) formed in the respective overlying block. The lowermost block 62 is further provided with a pair of openings 70 for receiving the sill dowel pins 58.

Figure 12:
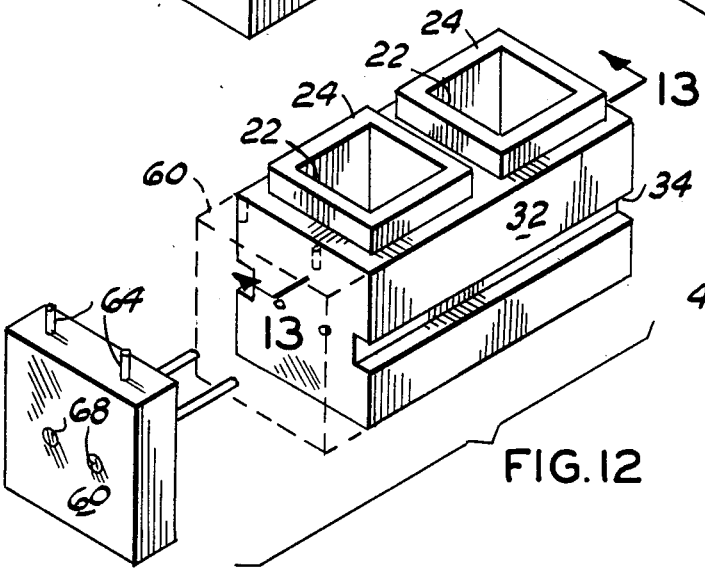
FIG. 12 is an exploded isometric view of the block of FIG. 8 and a nailable end attachment for the block with dotted lines illustrating its attached position.
Figure 13:
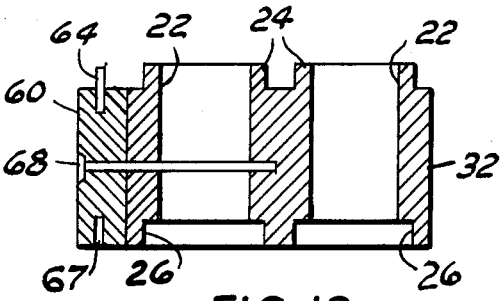
FIG. 13 is a vertical cross sectional view taken substantially along the line 13—13 of FIG. 12.

FIGS. 12 and 13 illustrate the manner of connecting the opening side jamb block 60 or 61 with the furring strip block 32 in which the screws or bolts 68 extend through the adjacent end wall of the blocks 32 across the cavity 22 and into the central part of the block.

Figure 14:
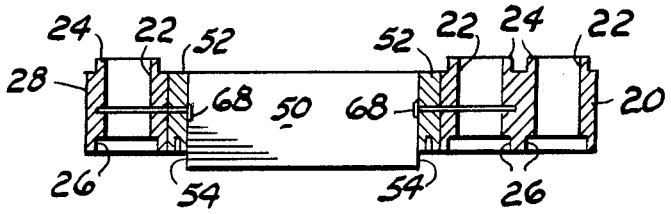
FIG. 14 is a vertical cross sectional view, to a smaller scale, taken substantially along the line 14—14 of FIG. 1 illustrating the wall opening header block connected with a standard size block and a half size block.

FIG. 14 illustrates the manner of connecting a standard size block 20 and half size block 28 to respective ends of the opening head block 48 by extending one of the bolts 68 through the block end walls 52 which similarly enters the respective blocks 20 and 28.

Figure 15:
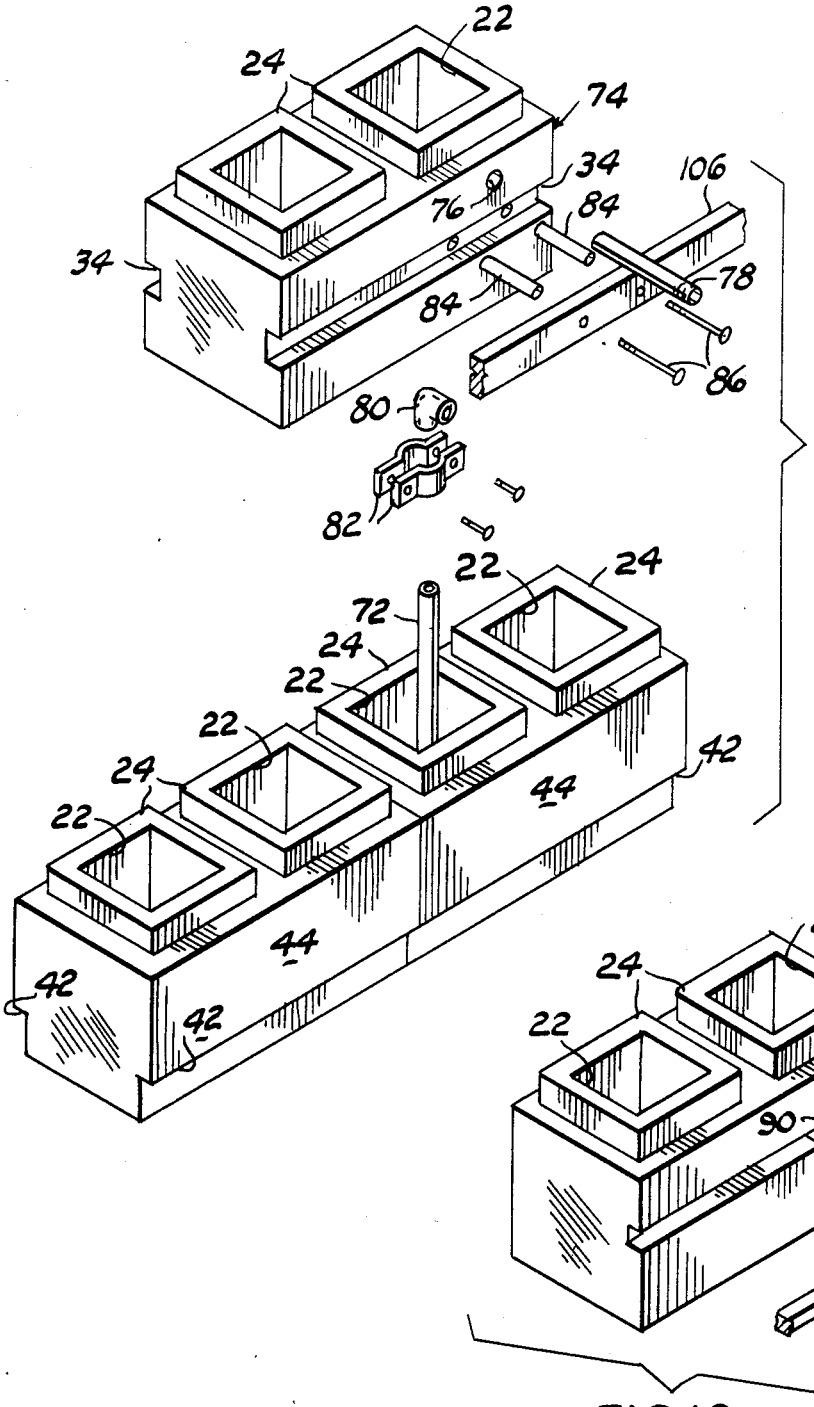
FIG. 15 is an exploded isometric view illustrating the installation of plumbing components and their supports; and, FIG. 16 is an exploded isometric view illustrating a standard size block modified for the installation of an electrical outlet box.

FIG. 15 illustrates the manner of installing plumbing fittings in a wall formed by the blocks in which a length of pipe 72 projects upwardly through a standard size block opening 22 and enters the opening 22 of a modified form of the furring strip block, indicated at 74. The block 74 is provided with a lateral opening 76 for receiving a short nipple or length of pipe 78 normal to the pipe 72 and connected therewith by an elbow 80. Clamp means 82 surround the pipe 72 and overlies a pair of bolt surrounding parallel spacers 84 within the cavity 22 projecting inwardly from the block side wall through suitable openings. Bolts 86, extending through a length of furring strip 106, nested by the groove 34, enter and support the spacers 84.

Figure 16:
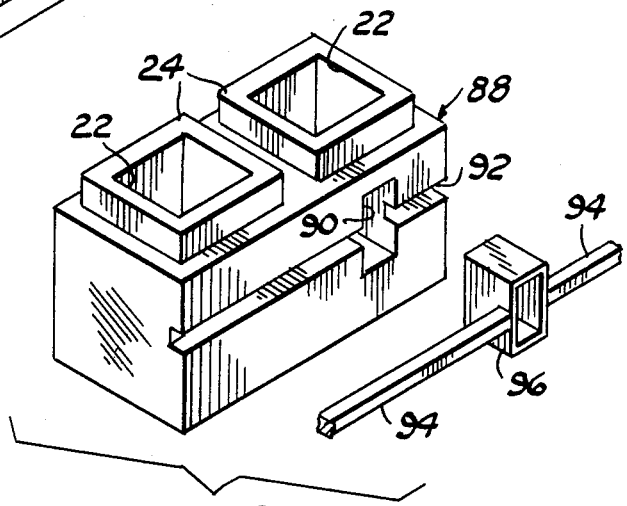

FIG. 16 illustrates an electrical outlet supporting box block 88 having a lateral recess 90 communicating with one of its cavities 22 and provided along its adjacent marginal side surface with a horizontal groove or recess 92 for nesting an intermediate portion of strip material 94 secured to and projecting in opposing directions from opposing sides of a conventional electrical outlet box 96 nested by the block recess 90.

Referring to FIG. 1, the numeral 100 illustrates a wall formed by several courses of the building blocks of the invention. The bottom or base course A is formed by a plurality of the baseboard blocks 40 laid in end to end abutting relation overlying a foundation 102. At one end of the wall, one of the baseboard blocks 44 is utilized for the purpose of applying a baseboard 104 thereto nested by the grooves 42 and 46 of the blocks.

The second course B is formed from a plurality of the furring strip blocks 32 longitudinally overlying the baseboard blocks 40 in staggered relation so that each of the blocks 32 overlies one-half of each of two end abutted underlying blocks 40 wherein the tongues 24 of the blocks are nested by the tongue receiving groove or rabbeted edge 26 in the overlying block 32. This feature prevents horizontal movement of the blocks relative to each other in either a lateral or longitudinal direction and vertically aligns the cavities 22 of the overlying blocks with the cavities of the underlying blocks. The wall course B includes one of the plumbing fitting receiving blocks 74 at a selected location for receiving the plumbing fittings, as described hereinabove. Similarly, wall end or corner furring strip blocks 36 are utilized at the respective ends of the course B to form a continuation of furring strips 106 nested by the grooves 34 and 38 by the furring strip blocks 32 and 36.

The course C illustrates a similar placement of standard size blocks 20 overlying the course B blocks and including the electrical outlet block 88 interposed between two furring strip blocks 32. The electrical outlet 96 and its supporting strip 94 being installed at a selected time.

Wall course D is formed by a plurality of standard blocks 20 and a half block 28 with a desired dimension window opening or spacing being provided between selected blocks to define the lower portion of a window opening 108 in which the window jamb blocks 62 are connected with a half block 28 and a standard block 20 at opposite sides of the opening. The nailable window sill panel 56 is interposed between the blocks 62 in dowel pin connected relation.

Course E is formed in a similar manner by a plurality of standard size blocks 32 with a half block 28A and standard size block at opposite sides of the window opening 108 having the window jamb blocks 61 similarly secured thereto.

Course F utilizes substantially an identical arrangement of the blocks utilized in course D in which the wall jamb blocks 60 are secured to a half block 28, a standard size block 20 at the opposite sides of the window opening 108.

Course G utilizes the window header 48 having a standard size block 20 connected to one end and a half size block 28 connected to its other end, in the manner illustrated by FIG. 14, which spans the window opening. The remaining portion of wall course G is formed by standard size wall blocks 20.

The wall course H is formed by a plurality of furring strip blocks 32 and 36 substantially as described for the wall course B with the exception the plumbing fitting block 74 is not used.

The wall top course J is formed by a plurality of the top blocks 30 overlying the wall course H in which the top blocks similarly nest the upstanding tongues on the blocks 32 of the course H.

The baseboards 104 and several furring strips are secured in their respective grooves by suitable bolt-like fasteners projecting through the furring strip and walls of selected blocks and project into the respective block cavities 22. During or following the erection of the wall, fluid concrete 110 is poured into all or selected vertically aligned cavities of the several blocks extending from the foundation 102 to the upper limit of the top blocks 30 which, when solidified, adds rigidity to the erected wall as well as firmly anchoring the bolts 68 and other furring strip fasteners.

Obviously the invention is susceptible to changes or alterations without defeating its practicability. Therefore, I do not wish to be confined to the preferred embodiment shown in the drawings and described herein.

I claim:

1. A wall, comprising:

a first course of building blocks including a first block having a first block surface in which a first groove is defined for receiving a baseboard;

a second course of building blocks, disposed above said first course, including a second block having a second block surface extending between a top surface and a bottom surface, said second block surface having a second groove defined therein in spaced relation to the boundaries at which said second block surface intersects said top and bottom surfaces; and a third course of building blocks, disposed above said second course, including a third building block having a cavity defined therein and further having a third block surface in which an opening is defined, said opening communicating with said cavity and said opening being defined for receiving a pin extending from a jamb member into said cavity when said jamb member is disposed adjacent said third block surface to define part of an opening through said wall.

2. A wall as defined in claim 1, wherein:

said wall further comprises a fourth course of building blocks, disposed above said third course, including a fourth building block defining at least part of the top of said wall;

each of said first, second and third building blocks includes an upstanding tongue and a recess defined in the block opposite said tongue, said tongue being defined for nesting in a recess of an upwardly adjacent building block of an adjacent course and said recess being defined for receiving a tongue of a downwardly adjacent building block of an adjacent course; and said fourth building block includes at least one of said recesses defined therein, but does not include one of said upstanding tongues.

3. A wall as defined in claim 2, wherein said wall further comprises a column of cement for reinforcing said courses of building blocks and for anchoring said pin of said jamb member.

4. A wall as defined in claim 1, wherein said wall further comprises a column of cement for reinforcing said courses of building blocks and for anchoring said pin of said jamb member.

5. An interlocking block assembly for a wall having two spaced planar surfaces, comprising:

a building block having a cavity defined therein, said building block including:

a first side wall having a first outer surface for defining at least part of one of the two planar surfaces of the wall, and having a first inner surface for defining at least part of said cavity;

a second side wall disposed in spaced relation to said first side wall, said second side wall having a second outer surface for defining at least part of the other of the two planar surfaces of the wall and having a second inner surface for defining at least part of said cavity;

a lateral wall extending between said first and second side walls so that said lateral wall defines at least part of an interior of the wall, said lateral wall having a lateral surface for defining at least part of said cavity, said lateral surface having an indentation defined therein in communication with said cavity; and an end wall, extending between corresponding ends of said first and second side walls, said end wall having an outer end surface for defining at least part of an opening through the wall and having an inner end surface for defining at least part of said cavity, said end wall having an aperture defined therethrough in communication between said outer end surface and said cavity and in alignment with said indentation; and a jamb connected to the wall, said jamb including: nailable block means, disposed adjacent said outer end surface, for defining at least part of the jamb in the wall; and bolt means, disposed through said nailable block means, said aperture, and said cavity and into said indentation, for securing said nailable block means to said building block.

6. An assembly as defined in claim 5, wherein:

said first outer surface has a groove defined therein, said groove extending along the length of said first side wall and perpendicularly intersecting said outer end surface; and said block assembly further comprises a furring strip disposed in said groove, said furring strip having an end abutting said nailable block means.

* * * * *